US011717934B2

(12) United States Patent
Hoshikawa

(10) Patent No.: US 11,717,934 B2
(45) Date of Patent: Aug. 8, 2023

(54) ANNULAR FRAME CLEANING ACCESSORY FOR GRINDING APPARATUS

(71) Applicant: DISCO CORPORATION, Tokyo (JP)

(72) Inventor: Hirotoshi Hoshikawa, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 17/450,481

(22) Filed: Oct. 11, 2021

(65) Prior Publication Data

US 2022/0143781 A1 May 12, 2022

(30) Foreign Application Priority Data

Nov. 11, 2020 (JP) ..... 2020-187881

(51) Int. Cl.
*B24B 41/06* (2012.01)
*B24B 7/22* (2006.01)

(52) U.S. Cl.
CPC ..... *B24B 41/068* (2013.01); *B24B 7/228* (2013.01)

(58) Field of Classification Search
CPC ..... B24B 41/068; B24B 7/228; B24B 41/005; B24B 1/00; B24B 57/02; B24B 7/04; B24B 53/007; B24B 53/017; B24B 37/00; B24B 37/04; B24B 37/042; B24B 37/07; B24B 37/10; B24B 37/107; B24B 37/27; B24B 37/30; B24B 37/32; B24B 37/34; B24B 37/345; H01L 21/304; H01L 21/67092; H01L 21/02096; H01L 21/02087;

(Continued)

(56) References Cited

U.S. PATENT DOCUMENTS 5,311,634 A * 5/1994 Andros ..... H01L 21/67046 15/230.18
6,234,883 B1 * 5/2001 Berman ..... B24B 53/017 451/286

(Continued)

FOREIGN PATENT DOCUMENTS

CN 105097613 B * 4/2019 ..... H01L 21/67092
JP 2002299295 A * 10/2002
JP 2010247311 A 11/2010

OTHER PUBLICATIONS

Translation of JP2002299295A (Year: 2002).*

*Primary Examiner* — Brian D Keller
*Assistant Examiner* — Steven Huang
(74) *Attorney, Agent, or Firm* — Greer Burns & Crain, Ltd.

(57) ABSTRACT

A grinding apparatus includes a chuck table that holds a workpiece through a protective tape, where the protective tape is attached to one surface of an annular frame so as to cover an opening of the annular frame and the workpiece is attached to the protective tape on an inner side of an inner circumferential edge of the opening of the annular frame; a grinding unit for grinding the workpiece; and a frame cleaning unit that cleans the other surface located on a side opposite to the one surface of the annular frame obtained after grinding of the workpiece, and wherein the frame cleaning unit has either: (i) a first cleaning member configured and arranged for making contact with the other surface of the annular frame and having flexibility, or (ii) a second cleaning member that jets at least either gas or liquid from above the other surface of the annular frame.

14 Claims, 9 Drawing Sheets

(58) Field of Classification Search
CPC ..... H01L 21/67023–67051; H01L 21/0209; A46B 2200/30; B08B 1/00; B08B 11/00
USPC ..... 451/285–288; 15/77, 88.1, 97.1, 102
See application file for complete search history.

(56) References Cited

U.S. PATENT DOCUMENTS

| | | | | |
|---|---|---|---|---|
| 6,598,255 | B1 * | 7/2003 | Gohda | H01L 21/67046 15/230.16 |
| 2007/0226925 | A1 * | 10/2007 | Hiraoka | H01L 21/67046 15/88.2 |
| 2010/0108095 | A1 * | 5/2010 | Mouri | H01L 21/67051 134/99.1 |
| 2014/0190633 | A1 * | 7/2014 | Maeda | B24B 37/34 134/103.3 |
| 2018/0099373 | A1 * | 4/2018 | Sekiya | H01L 21/67132 |

* cited by examiner

ANNULAR FRAME CLEANING ACCESSORY FOR GRINDING APPARATUS

BACKGROUND OF THE INVENTION

Field of the Invention

The present invention relates to a grinding apparatus including a chuck table that holds under suction a workpiece through a pressure sensitive adhesive tape and a grinding unit that has a grindstone that grinds the workpiece held by the chuck table.

Description of the Related Art

Device chips having an integrated circuit (IC), large scale integration (LSI), or the like are mounted on mobile phones, personal computers, and the like. The device chips are generally manufactured by grinding a back surface side of a silicon wafer formed with a plurality of devices on a front surface side, to thin the silicon wafer to a predetermined thickness, and thereafter dividing the silicon wafer on a device basis. In addition, chip type light emitting elements such as a light emitting diode (LED) are mounted on displays, illumination devices, and the like. The chip type light emitting elements are manufactured by forming a plurality of light emitting elements on a front surface of a sapphire substrate which is excellent in mechanical and thermal properties, chemical stability, and the like as compared to the silicon wafer, thereafter grinding a back surface side of the sapphire substrate, and then dividing the sapphire substrate on a light emitting element basis.

Besides, device chips having a power metal-oxide-semiconductor field-effect transistor (power MOSFET), an insulted gate bipolar transistor (IGBT), or the like are mounted on power devices (power transistor elements). For device chips for a power device, for example, a silicon carbide (SiC) substrate, which is good in electrical properties and higher than a silicon wafer in dielectric breakdown electric field strength, is used. The device chips for a power device are manufactured by grinding a back surface side of an SiC substrate formed with a plurality of devices on a front surface side, and then dividing the SiC substrate on a device basis.

As the sapphire substrate or the SiC substrate, small-type substrates with a diameter of 2 inches (approximately 50.8 mm) to 4 inches (approximately 100 mm) are mainly distributed. The diameter of the small-type substrates is smaller than the diameter of general silicon wafers having a diameter of 8 inches (approximately 200 mm) or 12 inches (approximately 300 mm). In regard of such small-type substrates, for preventing damage during transportation or the like, for example, grinding and conveying may be performed in the form of a frame unit in which the plurality of small-type substrates are supported by a metallic annular frame through a pressure sensitive adhesive tape (see, for example, Japanese Patent Laid-open No. 2010-247311).

It is to be noted, however, that if grinding swarf generated by grinding is deposited on the annular frame, it may lead to defective conveyance when the annular frame is conveyed by a conveying unit, or defective peeling when the pressure sensitive adhesive tape is peeled off from the annular frame by a tape peeling device. In addition, the grinding swarf deposited on the annular frame may become a dust that contaminates a clean room. In view of this, removing the grinding swarf from the annular frame by manual wiping by the worker may be one possible solution, but there is a problem of an increased number of steps due to the manual work.

SUMMARY OF THE INVENTION

The present invention has been made in consideration of such a problem. It is an object of the present invention to provide a grinding apparatus by which it is possible to omit a step of manually removing grinding swarf deposited on an annular frame.

In accordance with an aspect of the present invention, there is provided a grinding apparatus including a chuck table that holds under suction a workpiece through a protective tape, where the protective tape is attached to one surface of an annular frame so as to cover an opening of the annular frame and the workpiece is attached to the protective tape on an inner side than an inner circumferential edge of the opening of the annular frame; a grinding unit that has a grindstone for grinding the workpiece held by the chuck table; and a frame cleaning unit that cleans the other surface located on a side opposite to the one surface of the annular frame obtained after grinding of the workpiece.

Preferably, the frame cleaning unit has either a first cleaning member capable of making contact with the other surface of the annular frame and having flexibility or a second cleaning member that jets at least either gas or liquid from above the other surface of the annular frame, and either the first cleaning member or the second cleaning member and the annular frame with the one surface side held by the chuck table are relatively moved, and the other surface of the annular frame is cleaned by the frame cleaning unit.

Preferably, the frame cleaning unit further includes a driving mechanism that moves either the first cleaning member or the second cleaning member, between a cleaning position located directly above the chuck table and a retracted position located on an outer side than a peripheral part of the chuck table.

Preferably, the frame cleaning unit has the first cleaning member, the frame cleaning unit is spaced from a grinding region of the chuck table where grinding of the workpiece is conducted, and the frame cleaning unit is provided adjacent to a conveying-in/conveying-out region where conveying-in and conveying-out of the workpiece relative to the chuck table are performed.

Preferably, the first cleaning member has any one of one block-shaped sponge body, a plurality of sponge bodies, and one annular sponge body having an inside diameter corresponding to a diameter of the inner circumferential edge of the opening of the annular frame.

Preferably, the frame cleaning unit has the second cleaning member, the frame cleaning unit is spaced from a grinding region of the chuck table where grinding of the workpiece is conducted, and the frame cleaning unit is provided in a cleaning region where cleaning of the workpiece is conducted.

In the grinding apparatus according to one mode of the present invention, the other surface of the annular frame can be cleaned by the frame cleaning unit. Therefore, a step of manually removing grinding swarf deposited on the annular frame can be omitted.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
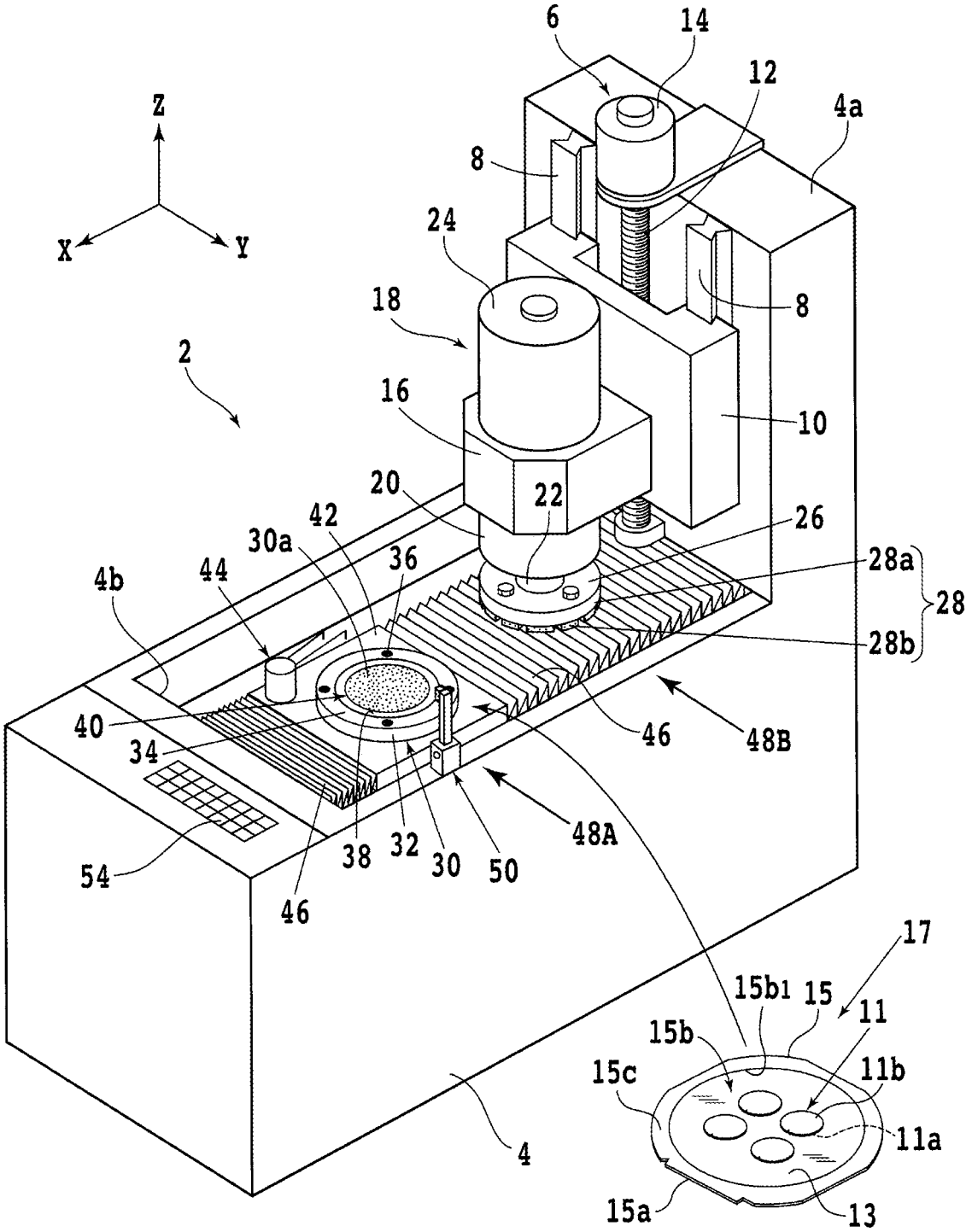
FIG. 1 is a perspective view of a grinding apparatus of a first embodiment.

Referring to the attached drawings, an embodiment according to one mode of the present invention will be described. FIG. 1 is a perspective view of what is generally called a manual type grinding apparatus 2 according to a first embodiment. Note that, in FIG. 1, an X-axis direction (front-rear direction), a Y-axis direction (left-right direction), and a Z-axis direction (grinding feeding direction, vertical direction) are orthogonal to one another. The grinding apparatus 2 has a base 4 for supporting or accommodating component elements. On the rear side (one side in the X-axis direction) of the base 4, a wall section 4*a* extending along the Z-axis direction is provided. The wall section 4*a* is provided with a grinding feeding unit 6.

The grinding feeding unit 6 has a pair of guide rails 8 along the Z-axis direction. Each of the guide rails 8 is fixed to a front surface (a surface on the other side in the X-axis direction) of the wall section 4*a*. A moving plate 10 is attached to the pair of guide rails 8 in the manner of being slidable in the Z-axis direction. A nut section (not illustrated) is provided on a rear surface (back surface) side of the moving plate 10, and a ball screw 12 disposed along the pair of guide rails 8 is connected to the nut section in a rotatable manner.

A drive source 14 such as a stepping motor is connected to an upper end portion of the ball screw 12, and when the drive source 14 is operated, the moving plate 10 can vertically be moved along the Z-axis direction. A grinding unit 18 is fixed to a front surface side of the moving plate 10 through a fixing member 16. The grinding unit 18 has a cylindrical spindle housing 20 disposed along the Z-axis direction. A part of a cylindrical spindle 22 is accommodated in the spindle housing 20 in a rotatable manner.

A rotational drive source 24 such as a servo motor is connected to an upper end portion of the spindle 22. A lower end portion of the spindle 22 protrudes downward from the spindle housing 20, and an upper surface side of a disc-shaped wheel mount 26 is fixed to the lower end portion. An annular grinding wheel 28 is mounted to a lower surface side of the wheel mount 26. The grinding wheel 28 has an annular wheel base 28*a*. An upper surface of the wheel base 28*a* is in contact with a lower surface of the wheel mount 26. In addition, a plurality of grindstones 28*b* are fixed to a lower surface of the wheel base 28*a* at substantially regular intervals along the circumferential direction of the wheel base 28*a*. The grindstones 28*b* are manufactured, for example, by mixing, molding, firing, or the like a binding material such as metal, ceramic, or resin and abrasive grains of diamond, cubic boron nitride (cBN), or the like.

A rectangular opening 4*b* whose longitudinal part is along the X-axis direction is formed on a lower side of the grinding unit 18. A chuck table 30 for holding under suction a workpiece 11 is disposed in the opening 4*b*. The chuck table 30 has a disc-shaped frame body 32. A plurality of permanent magnets 36 are provided at a peripheral portion 34 of the frame body 32 at substantially regular intervals along the circumferential direction of the frame body 32. The permanent magnets 36 can hold an annular frame 15 described later by attracting it by a magnetic force.

While the four permanent magnets 36 are provided along the circumferential direction of the frame body 32 in FIG. 1, the number of the permanent magnets 36 is not particularly limited to any number insofar as it is three or more. Note that electromagnets may be provided in place of the permanent magnets 36. In addition, in the case where one surface 15*a* side of the annular frame 15 is formed of an insulating material, an electrostatic chuck capable of holding under suction the insulating material by a Coulomb force may be provided in place of the permanent magnets 36.

Figure 3:
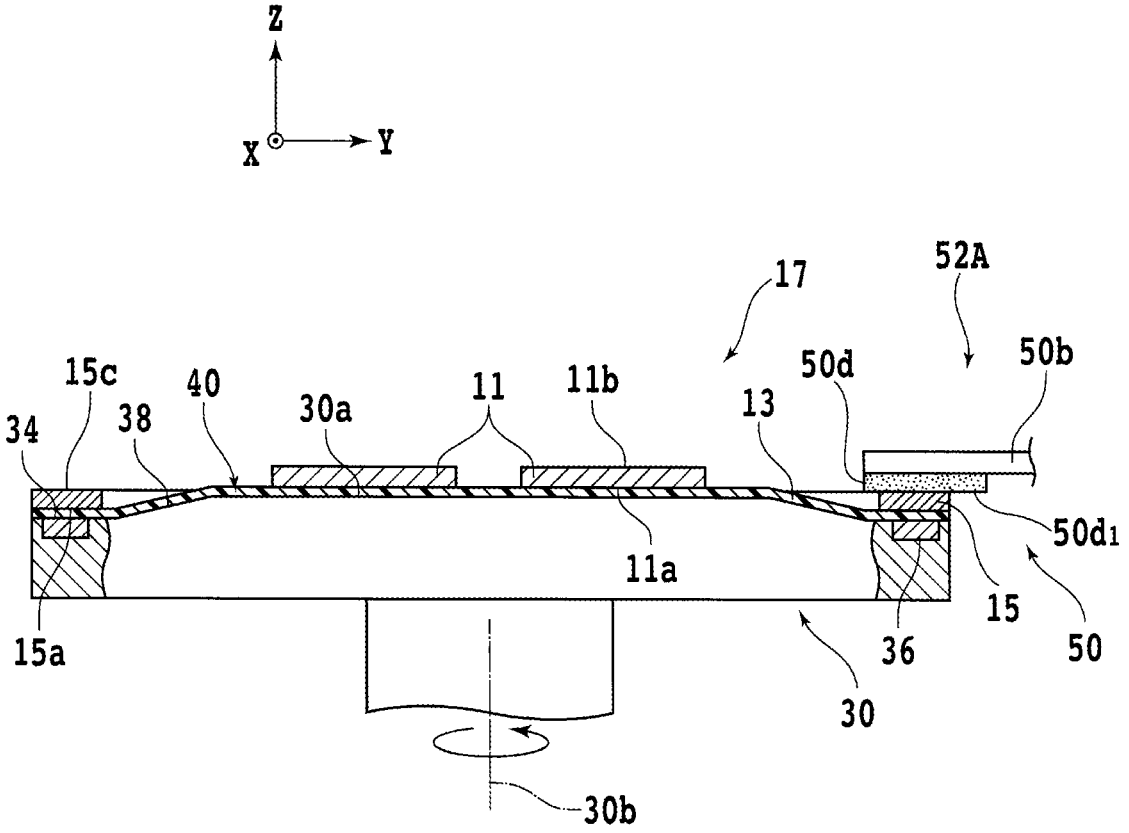
FIG. 3 is a diagram depicting the manner of cleaning an annular frame.

On the inner side of the peripheral portion 34 of the frame body 32, an inclined surface 38 having a shape corresponding to a frustoconical side surface is formed, and on the more central side than the inclined surface 38 in the radial direction of the frame body 32, a circular central portion 40 protruding upward than the peripheral portion 34 is formed (see FIG. 3). The central portion 40 is formed with a disc-shaped recess (not illustrated), and a disc-shaped porous plate formed of porous ceramic is fixed in the recess (see FIG. 1). The frame body 32 is formed with a channel (not illustrated) one end of which is connected to a suction source (not illustrated) such as a vacuum pump. In addition, the other end of the channel is connected to a bottom surface of the recess, and, when the suction source is operated, a negative pressure is transmitted to an upper surface of the porous plate. Thus, the upper surface of the porous plate functions as a holding surface 30*a* of the chuck table 30.

Here, referring to FIG. 1, the workpiece 11 held under suction by the holding surface 30*a* and the like will be described. The workpiece 11 of the first embodiment has a diameter in the range of 2 inches (approximately 50.8 mm) to 4 inches (approximately 100 mm). To a front surface 11*a* side of the workpiece 11, a protective tape 13 larger in diameter than the workpiece 11 is attached. The protective tape 13 of the first embodiment has a laminate structure of a base material layer and a pressure sensitive adhesive layer (glue layer), but the protective tape 13 may not have the pressure sensitive adhesive layer.

In the case where the protective tape 13 does not have the pressure sensitive adhesive layer, the protective tape 13 includes the base material layer, and, to the front surface 11*a* side of the workpiece 11, the base material layer is pressure bonded (for example, thermocompression bonded), whereby the protective tape 13 is attached to the workpiece 11. To a peripheral portion of the protective tape 13, the one surface 15*a* of the annular frame 15 formed of metal is attached. An opening 15*b* of the annular frame 15 is covered with the protective tape 13. At the opening 15*b*, the pressure sensitive adhesive layer of the protective tape 13 is exposed.

To the pressure sensitive adhesive layer on the inner side than an inner circumferential edge 15*b*$_1$ of the opening 15*b*, the front surface 11*a* side of each of a plurality of workpieces 11 is attached, and the back surface 11*b* side of the workpiece 11 is exposed together with the other surface 15*c* of the annular frame 15. The plurality of workpieces 11, the protective tape 13, and the annular frame 15 constitute a frame unit 17, and each workpiece 11 is supported by the annular frame 15 through the protective tape 13.

A rotational drive source (not illustrated) such as a motor is connected to a lower portion of the chuck table 30. The rotational drive source is capable of rotating the chuck table 30 at a high speed around a rotational axis 30*b* substantially parallel to the Z-axis direction (see FIG. 3). A moving plate (not illustrated) is fixed to a lower portion of the rotational drive source. The moving plate can be moved along the X-axis direction by an unillustrated X-axis moving mechanism. The X-axis moving mechanism is, for example, a ball screw mechanism.

Between the chuck table 30 and the rotational drive source, there is provided a cover table 42 which is rectangular in top plan view. Provided on the cover table 42 is a contact-type thickness measuring device 44. In addition, on both sides of the cover table 42 with respect to the X-axis direction, bellows-like covers 46 capable of contraction and expansion are provided. When the X-axis moving mechanism is operated, the chuck table 30 is moved along the X-axis direction together with the cover table 42. Specifically, the chuck table 30 is moved between a conveying-in/conveying-out region 48A where the frame unit 17 (workpiece 11) is conveyed in and conveyed out and a grinding region 48B where grinding of the workpiece 11 is conducted.

The conveying-in/conveying-out region 48A is spaced by a predetermined distance from the grinding region 48B, and is located on the front side of the opening 4*b*. At a position adjacent, in the Y-axis direction, to the chuck table 30 located in the conveying-in/conveying-out region 48A, a frame cleaning unit 50 for cleaning the annular frame 15 is provided. Here, referring to FIGS. 2A and 2B, the frame cleaning unit 50 will be described. The frame cleaning unit 50 has a rectangular parallelepiped base 50*a*. At an upper end portion of the base 50*a*, an arm 50*b* is provided through a rotary actuator (driving mechanism) 50*c*.

In the present embodiment, a vane type rotary actuator 50*c* driven by air is used, but other mechanisms may be adopted in place of the rotary actuator 50*c*. A base end portion of the arm 50*b* is connected to the rotary actuator 50*c* in the manner of being rotatable within a predetermined angular range in a Y-Z plane. A first cleaning member 50*d* is fixed to a tip portion of the arm 50*b*.

The first cleaning member 50*d* is formed of a material having flexibility with respect to the annular frame 15. The first cleaning member 50*d* of the first embodiment is formed of a sponge such as synthetic resin or marine sponge. It is to be noted, however, that the first cleaning member 50*d* is soft to such a degree as not to grind the other surface 15*c* of the annular frame 15, and a squeegee, a scraper, or the like formed of resin, rubber, or the like may be adopted, and a brush, a broom, a nonwoven fabric, or the like may be adopted, insofar as grinding swarf or the like deposited on the other surface 15*c* can be removed.

Note that, in the case where the first cleaning member 50*d* is formed of a material capable of absorbing liquid, such as a sponge and a nonwoven fabric, a liquid supply device (not illustrated) for supplying liquid to the first cleaning member 50*d* may be provided. The liquid supply device has, for example, a nozzle for jetting liquid to the first cleaning member 50*d*, and the nozzle is provided in the frame cleaning unit 50. In addition, for example, the liquid supply device has a vessel containing liquid in which the first cleaning member 50*d* is temporarily immersed, and the vessel is provided on the cover table 42.

Figure 2A:
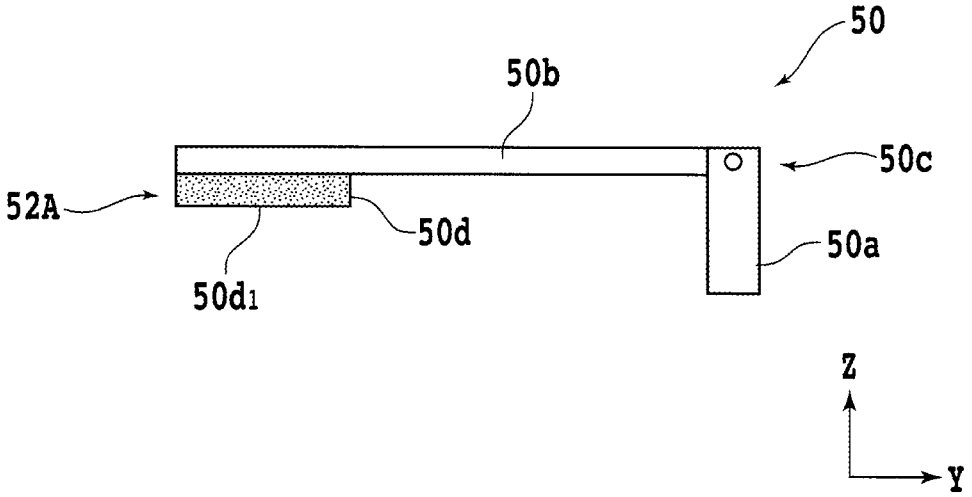
FIG. 2A is a diagram depicting a first cleaning member located at a cleaning position.

As depicted in FIG. 2A, when the rotary actuator 50*c* rotationally moves the arm 50*b* such that the arm 50*b* becomes substantially orthogonal to the Z-axis direction, the first cleaning member 50*d* is moved to a cleaning position 52A located directly above the peripheral portion 34. FIG. 2A is a diagram depicting the first cleaning member 50*d* located at the cleaning position 52A. When the first cleaning member 50*d* is located at the cleaning position 52A, a front surface 50*d*$_1$ of the first cleaning member 50*d* is positioned at such a height as to be able to make contact with the other surface 15*c* of the annular frame 15 held by the chuck table 30.

When the first cleaning member 50*d* and the annular frame 15 are relatively moved in a state in which the first cleaning member 50*d* is in contact with the other surface 15*c* of the annular frame 15, grinding swarf deposited on the other surface 15*c* can automatically be cleaned. In the present embodiment, by rotating the chuck table 30, the other surface 15*c* of the annular frame 15 is cleaned by the first cleaning member 50*d*. Since the other surface 15*c* can automatically be cleaned in the manner described above, a step of manually removing the grinding swarf can be omitted.

Figure 2B:
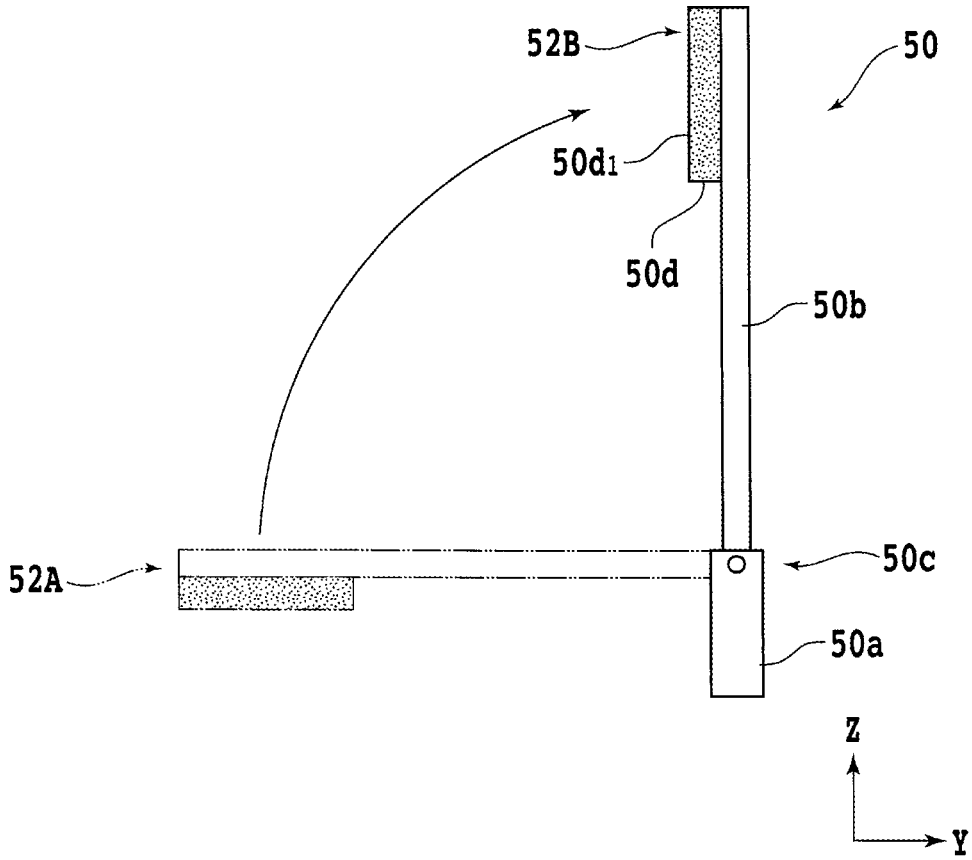
FIG. 2B is a diagram depicting the first cleaning member located at a retracted position.

In addition, when the rotary actuator 50*c* rotationally moves the arm 50*b* such that the arm 50*b* becomes substantially parallel to the Z-axis direction, the first cleaning member 50*d* is disposed at the retracted position 52B on the outer side than the peripheral portion 34 of the chuck table 30 (see FIG. 2B). Similar to FIG. 1, FIG. 2 is a diagram depicting the first cleaning member 50*d* located at the retracted position 52B. Naturally, when the first cleaning member 50*d* is located at the retracted position 52B, the front surface 50*d*$_1$ of the first cleaning member 50*d* cannot make contact with the other surface 15*c* of the annular frame 15.

Returning to FIG. 1, other component elements of the grinding apparatus 2 will be described. At an end portion on the front side of the base 4, an operation panel 54 for the operator to input grinding conditions and the like is provided. Besides, the grinding apparatus 2 includes a control section (not illustrated) for controlling operations of the grinding feeding unit 6, the grinding unit 18, the X-axis moving mechanism, the chuck table 30, the frame cleaning unit 50, and the like. The control section includes, for example, a computer including a processor (processing device) represented by a central processing unit (CPU), a main storage device such as a dynamic random access memory (DRAM), a static random access memory (SRAM), or a read only memory (ROM), and an auxiliary storage device such as a flash memory, a hard disc drive, or a solid state drive. In the auxiliary storage device, software including a predetermined program is stored. By operating the processing device and the like according to the software, the functions of the control section are realized.

Next, an example of the procedure of cleaning the other surface 15*c* of the annular frame 15 by the frame cleaning unit 50 will be described. First, the operator confirms that the first cleaning member 50*d* is located at the retracted position 52B, and mounts the frame unit 17 on the chuck table 30 disposed in the conveying-in/conveying-out region 48A, in the manner that the back surface 11*b* and the other surface 15*c* are directed upward (conveying-in step S10). Thereafter, the workpiece 11 is held under suction by the holding surface 30*a* through the protective tape 13, the one surface 15*a* side of the annular frame 15 is attraction-held by the permanent magnets 36, and thereafter, the X-axis moving mechanism moves the chuck table 30 into the grinding region 48B (moving step S20).

After the moving step S20, the chuck table 30 and the grinding wheel 28 are rotated in predetermined directions at a high speed, and, while the thickness of the workpiece 11 is measured by the thickness measuring device 44, the grinding unit 18 is lowered at a predetermined feeding speed by the grinding feeding unit 6. When the grindstones 28*b* make contact with the back surface 11*b* side of the workpiece 11, the back surface 11*b* side is ground (grinding step S30). In the grinding step S30, the workpiece 11 is ground while grinding water such as pure water is supplied to the grindstones 28*b*. Thus, grinding water containing grinding swarf is scattered, and grinding swarf, grinding water, and the like are deposited on the other surface 15*c* of the annular frame 15.

After each workpiece 11 is ground to a predetermined thickness, the grinding unit 18 is raised. Next, the other surface 15*c* is cleaned by the first cleaning member 50*d* (cleaning step S40). In the cleaning step S40, first, the chuck table 30 is moved into the conveying-in/conveying-out region 48A, and the first cleaning member 50*d* is moved to the cleaning position 52A. As a result, the front surface $\mathbf{50}d_1$ of the first cleaning member 50*d* makes contact with the other surface 15*c* of the annular frame 15. In this state, the chuck table 30 is rotated around the rotational axis 30*b*, whereby the annular frame 15 and the frame cleaning unit 50 are relatively moved along the other surface 15*c*, and the other surface 15*c* is cleaned by the first cleaning member 50*d* (see FIG. 3).

FIG. 3 is a diagram depicting the manner of cleaning the annular frame 15. In the cleaning step S40 of the first embodiment, the position of the first cleaning member 50*d* is fixed, and the chuck table 30 is rotated, whereby the other surface 15*c* is cleaned by the first cleaning member 50*d*. As described above, in the first embodiment, the other surface 15*c* of the annular frame 15 can be cleaned by the first cleaning member 50*d*. Thus, a step of manually removing the grinding swarf deposited on the annular frame 15 can be omitted.

Note that, in the case where the liquid supply device has a nozzle (second cleaning member) for jetting liquid, the nozzle may supply the liquid directly to the other surface 15*c* of the annular frame 15, instead of supplying the liquid to the first cleaning member 50*d*. The nozzle is attached to the arm 50*b* so as to be able to be moved by the rotary actuator 50*c*. In the conveying-in/conveying-out region 48A, while liquid is jetted from the nozzle to the other surface 15*c* of the annular frame 15, the chuck table 30 is rotated relative to the nozzle, whereby the other surface 15*c* of the annular frame 15 can be cleaned. The nozzle can be provided in place of the first cleaning member 50*d* or together with the first cleaning member 50*d*.

(First Modification)

Figure 4A:
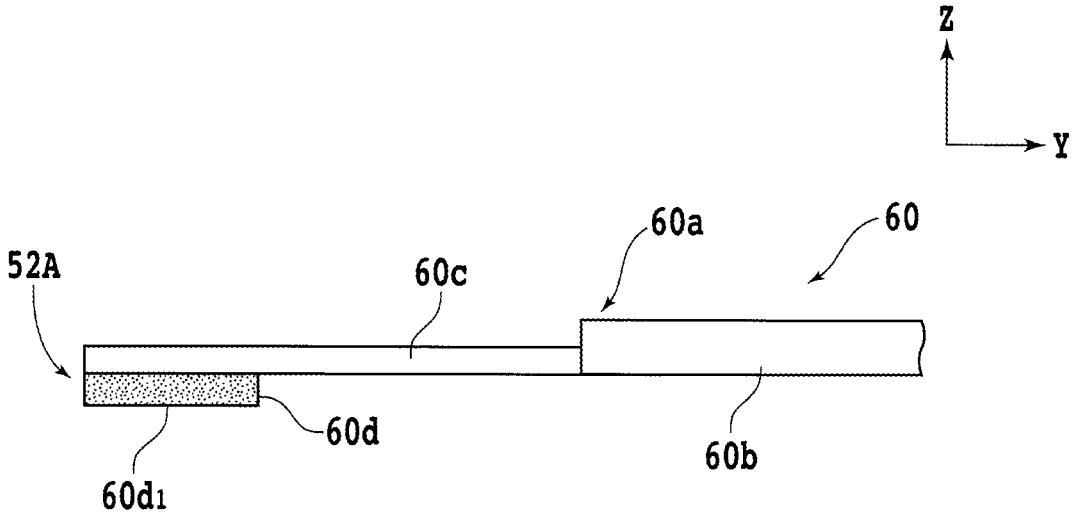
FIG. 4A is a diagram depicting the first cleaning member located at the cleaning position.
Figure 4B:
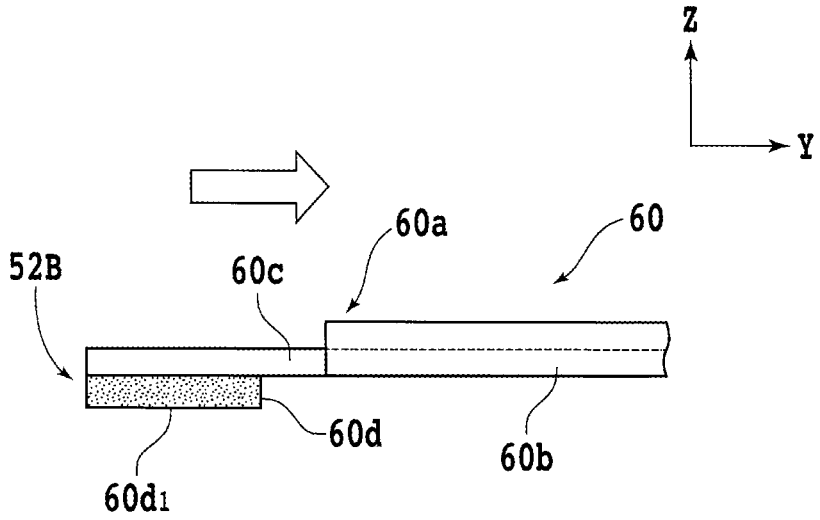
FIG. 4B is a diagram depicting the first cleaning member located at the retracted position.

Next, various modifications of the first embodiment will be described. FIGS. 4A and 4B depict a frame cleaning unit 60 of a first modification. The frame cleaning unit 60 of the first modification has an air cylinder (driving mechanism) 60*a*, instead of a rotary actuator. A part of a piston rod 60*c* is accommodated in a cylinder tube 60*b* in the manner of being able to advance and retract. The first cleaning member 60*d* is fixed to a tip portion of the piston rod 60*c*. The first cleaning member 60*d* is the same one block-shaped sponge body as the first cleaning member 50*d* is, and thus, description thereof is omitted.

The piston rod 60*c* is disposed such that its longitudinal direction is substantially orthogonal to the Z-axis direction, and the piston rod 60*c* is moved between a cleaning position 52A (see FIG. 4A) and a retracted position 52B (see FIG. 4B). FIG. 4A is a diagram depicting the first cleaning member 60*d* located at the cleaning position 52A in the first modification. When the first cleaning member 60*d* is located at the cleaning position 52A, the first cleaning member 60*d* is located on an upper side of the peripheral portion 34 of the chuck table 30, and a front surface $\mathbf{60}d_1$ of the first cleaning member 60*d* makes contact with the other surface 15*c* of the annular frame 15.

FIG. 4B is a diagram depicting the first cleaning member 60*d* located at the retracted position 52B in the first modification. When the first cleaning member 60*d* is located at the retracted position 52B, the first cleaning member 60*d* is located on the outer side than the peripheral portion 34 of the chuck table 30, and the front surface $\mathbf{60}d_1$ does not make contact with the other surface 15*c*.

(Second Modification)

Figure 5A:
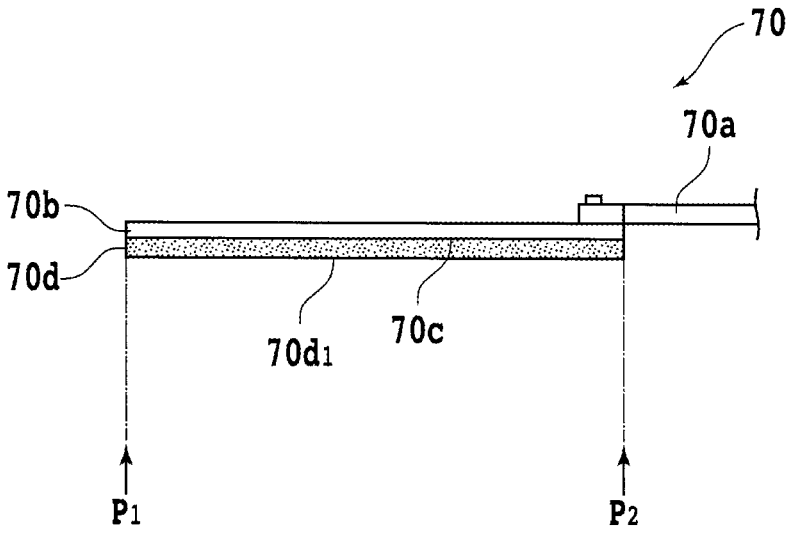
FIG. 5A is a side view of the first cleaning member.
Figure 5B:
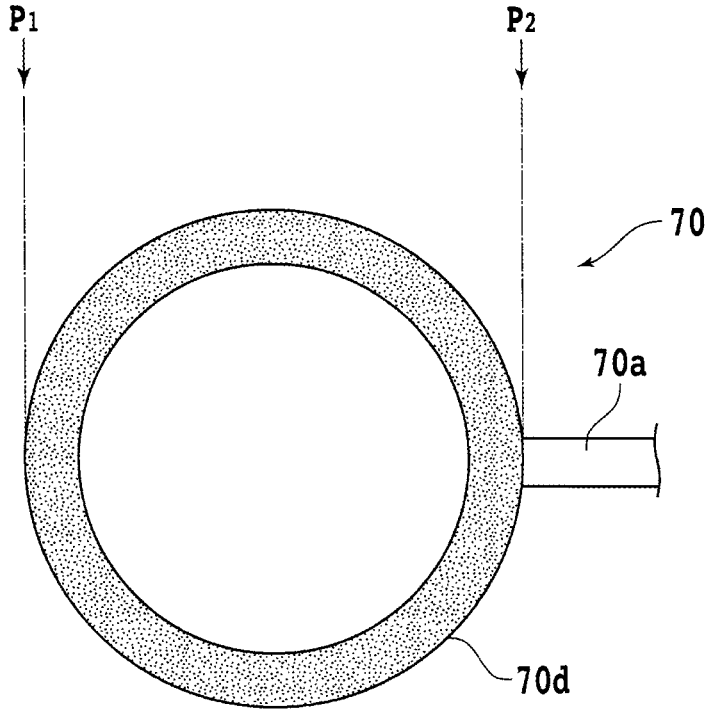
FIG. 5B is a bottom view of the first cleaning member.

FIGS. 5A and 5B depict a frame cleaning unit 70 of a second modification. The frame cleaning unit 70 has an arm 70*a*, and a part of an annular base section 70*b* is fixed to a tip portion of the arm 70*a*. One surface 70*c* of the base section 70*b* has an area substantially equal to or greater than the area of the other surface 15*c*. For example, the inside diameter of the base section 70*b* is substantially equal to the diameter of the inner circumferential edge $\mathbf{15}b_1$ of the annular frame 15, and the outside diameter of the base section 70*b* is substantially equal to the outermost diameter of the other surface 15*c*.

In addition, an annular first cleaning member 70*d* having substantially the same shape as the base section 70*b* is fixed to the one surface 70*c* of the base section 70*b*. The first cleaning member 70*d* is one annular sponge body, which is formed of the same material as the first cleaning member 50*d*. When the first cleaning member 70*d* is located at the cleaning position 52A, a front surface $\mathbf{70}d_1$ of the first cleaning member 70*d* makes contact with the other surface 15*c* of the annular frame 15, but when the first cleaning member 70*d* is located at the retracted position 52B, the front surface $\mathbf{70}d_1$ does not make contact with the other surface 15*c*.

FIG. 5A is a side view of the first cleaning member 70*d* in the second modification, and FIG. 5B is a bottom view of the first cleaning member 70*d* in the second modification. Note that points $P_1$ depicted in FIGS. 5A and 5B are located at corresponding positions. This similarly applies to points $P_2$ depicted in FIGS. 5A and 5B. Note that a driving mechanism for moving the arm 70*a* between the cleaning position 52A and the retracted position 52B may be a rotary actuator depicted in FIGS. 2A and 2B, or may be an air cylinder depicted in FIGS. 4A and 4B.

(Third Modification)

Figure 6A:
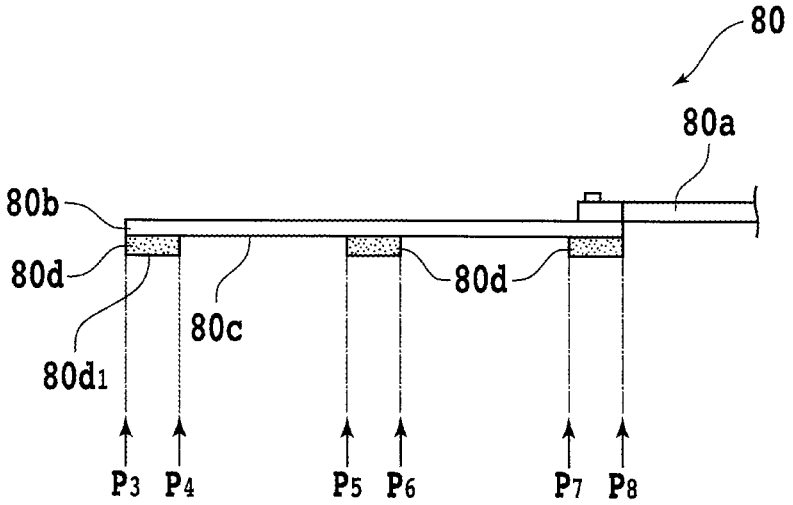
FIG. 6A is a side view of the first cleaning member.
Figure 6B:
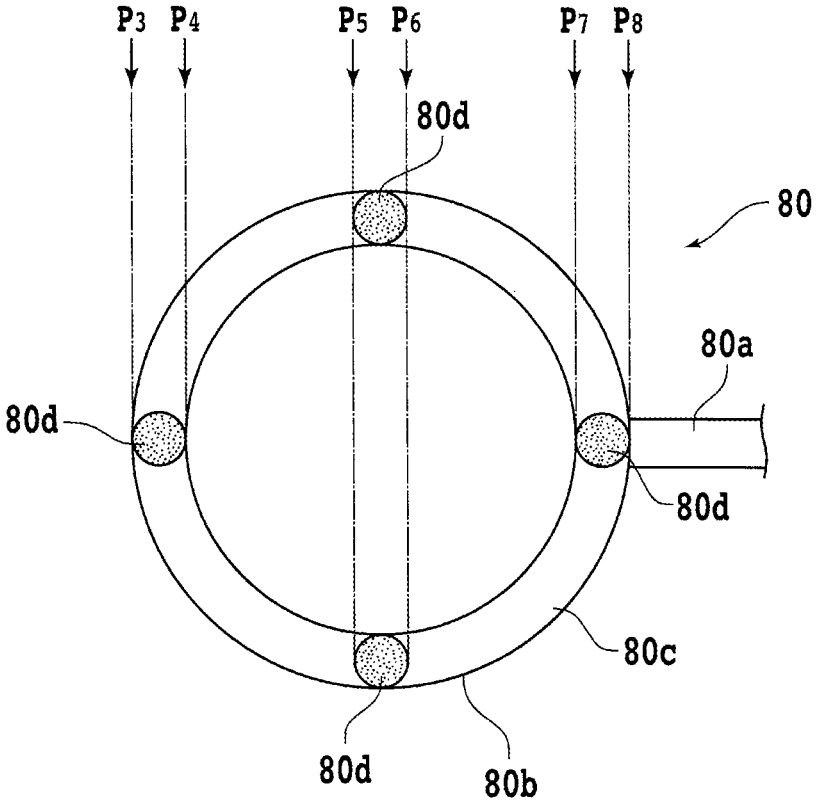
FIG. 6B is a bottom view of the first cleaning member.

FIGS. 6A and 6B depict a frame cleaning unit 80 of a third modification. The frame cleaning unit 80 has an arm 80*a* and a base section 80*b*, as the frame cleaning unit 70 does. It is to be noted, however, that a plurality of first cleaning members 80*d* are dispersedly disposed on one surface 80*c* of the base section 80*b*. The third modification is different from the second modification in this point, but is the same as the second modification in other points. Each of the first cleaning members 80*d* is a disc-shaped sponge body having a diameter substantially equal to the radial-directional width of the annular base section 70*b*.

When the first cleaning members 80*d* are located at the cleaning position 52A, the front surfaces 80$d_1$ of the first cleaning members 80*d* make contact with the other surface 15*c* of the annular frame 15, but when the first cleaning members 80*d* are located at the retracted position 52B, none of the front surfaces 80$d_1$ makes contact with the other surface 15*c*. FIG. 6A is a side view of the first cleaning member 80*d* in the third modification, and FIG. 6B is a bottom view of the first cleaning member 80*d* in the third modification. Points $P_3$ depicted in FIGS. 6A and 6B are located at corresponding positions. This similarly applies to points $P_4$ to $P_8$ depicted in FIGS. 6A and 6B. In the first to third modifications, also, the other surface 15*c* of the annular frame 15 can automatically be cleaned, as described in the first embodiment.

Figure 7:
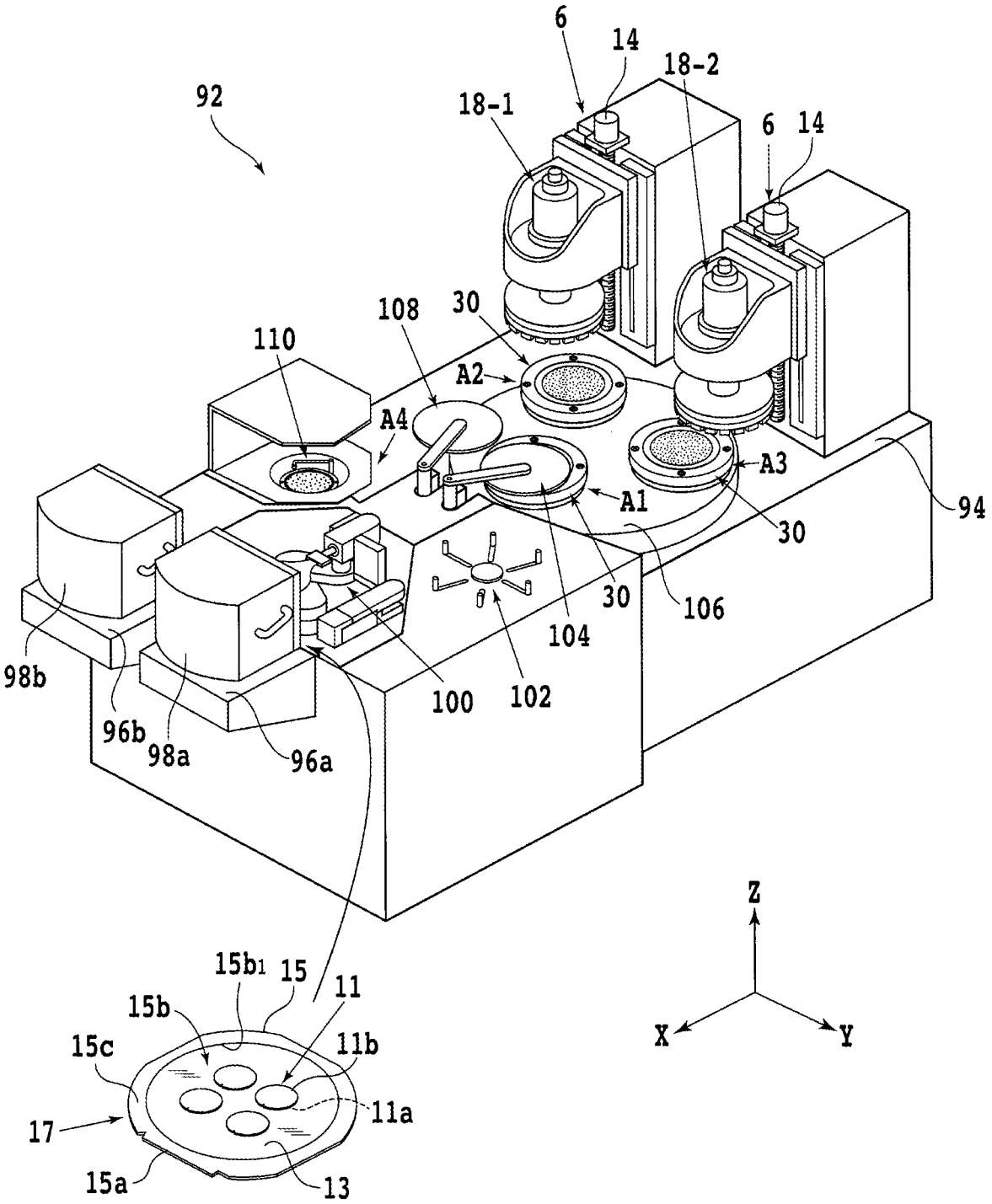
FIG. 7 is a perspective view of a grinding apparatus of a second embodiment.

Next, referring to FIGS. 7 to 9, a second embodiment will be described. FIG. 7 is a perspective view of a grinding apparatus 92 according to the second embodiment. The grinding apparatus 92 is of a full-automatic system, in which conveying-in, grinding, cleaning, and conveying-out of a workpiece 11 are automatically performed by the grinding apparatus 92. Cassette mount bases 96*a* and 96*b* are provided on the front side of a base 94 of the grinding apparatus 92. One or more frame units 17 (workpieces 11) are accommodated in a cassette 98*a* disposed on the cassette mount base 96*a*.

The frame unit 17 in the cassette 98*a* is conveyed to an aligning mechanism 102 by a conveying robot 100, and is thereafter conveyed onto a turntable 106 disposed on the rear side of the base 94, by a loading arm 104. Three chuck tables 30 are dispersedly disposed on the turntable 106 at substantially regular intervals along the circumferential direction of the turntable 106. One chuck table 30 is disposed in a conveying-in/conveying-out region A1 that is nearest to the loading arm 104. In addition, another chuck table 30 is disposed in a rough grinding region A2 directly below a rough grinding unit 18-1, and a further chuck table 30 is disposed in a finish grinding region A3 directly below a finish grinding unit 18-2.

The workpiece 11 conveyed onto the chuck table 30 in the conveying-in/conveying-out region A1 is rough-ground in the rough grinding region A2, is then subjected to finish grinding in the finish grinding region A3, and is thereafter returned into the conveying-in/conveying-out region A1. Note that the movement of the workpiece 11 is conducted by rotation of the turntable 106.

Thereafter, the workpiece 11 is conveyed from the chuck table 30 in the conveying-in/conveying-out region A1 to a cleaning unit (frame cleaning unit) 110 located on the more front side than the turntable 106, by an unloading arm 108.

The cleaning unit 110 is spaced from the rough grinding region A2 and the finish grinding region A3 (both of which are grinding regions), and is provided in a cleaning region A4 where cleaning of the workpiece 11 is conducted. While the cleaning unit 110 is what is generally called a spinner cleaning device, the cleaning unit 110 in the present embodiment cleans also the annular frame 15 in addition to the workpiece 11 obtained after grinding. FIG. 8 is an enlarged view of the cleaning unit 110. Note that, in FIG. 8, some of the component elements are depicted in bock diagrams. The cleaning unit 110 has the abovementioned chuck table 30 provided with a plurality of permanent magnets 36 at a peripheral portion 34 thereof.

A rotational drive source (not illustrated) such as a motor is connected to a bottom portion of the chuck table 30 of the cleaning unit 110. The rotational drive source rotates the chuck table 30 around a rotational axis 30*b* (see FIG. 3) substantially parallel to the Z-axis direction (see FIG. 9). A lift mechanism (not illustrated) for lifting the chuck table 30 upward and downward in the Z-axis direction is connected to a bottom portion of the rotational drive source. A cylindrical rotary column 112*a* disposed substantially in parallel to the Z-axis direction is provided at a side portion of the chuck table 30.

An arm 112*b* is connected to a side portion of an upper end portion of the rotary column 112*a* in the manner of being orthogonal to the rotary column 112*a*, and a nozzle (second cleaning member) 112*c* is provided at a tip portion of the arm 112*b* in the manner of being directed downward. The rotary column 112*a* and the arm 112*b* are formed with a first channel (not illustrated) supplied with cleaning water (liquid) 114*a* such as pure water and a second channel (not illustrated) supplied with air (gas) 116*a*.

A cleaning water supply source 114 is connected to the first channel. The cleaning water supply source 114 has a reservoir tank (not illustrated) in which cleaning water 114*a* is reserved and a pump and the like for supplying the cleaning water 114*a* from the reservoir tank to the first channel. An air supply source 116 is connected to the second channel. The air supply source 116 has a compressor (not illustrated) for compressing air 116*a*, an air tank (not illustrated) for reserving compressed air 116*a*, an air valve including a solenoid valve, and the like.

Figure 9:
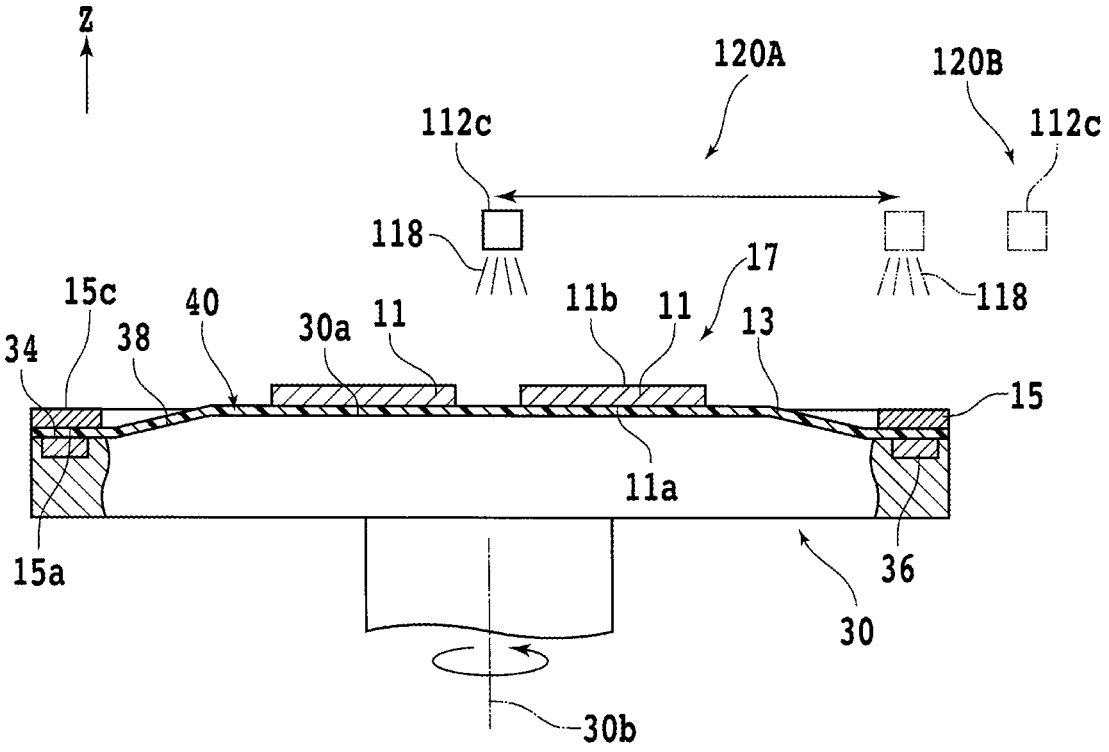
FIG. 9 is a diagram depicting the manner of cleaning a workpiece and the annular frame.

The cleaning water 114*a* supplied into the first channel and the air 116*a* supplied into the second channel are mixed with each other in the nozzle 112*c*, to be a binary fluid 118, which is jetted downward from the nozzle 112*c* (see FIG. 9). An oscillating mechanism (driving mechanism) 120 including a motor or the like for oscillating the nozzle 112*c* in a predetermined range is connected to a lower end portion of the rotary column 112*a*.

Figure 8:
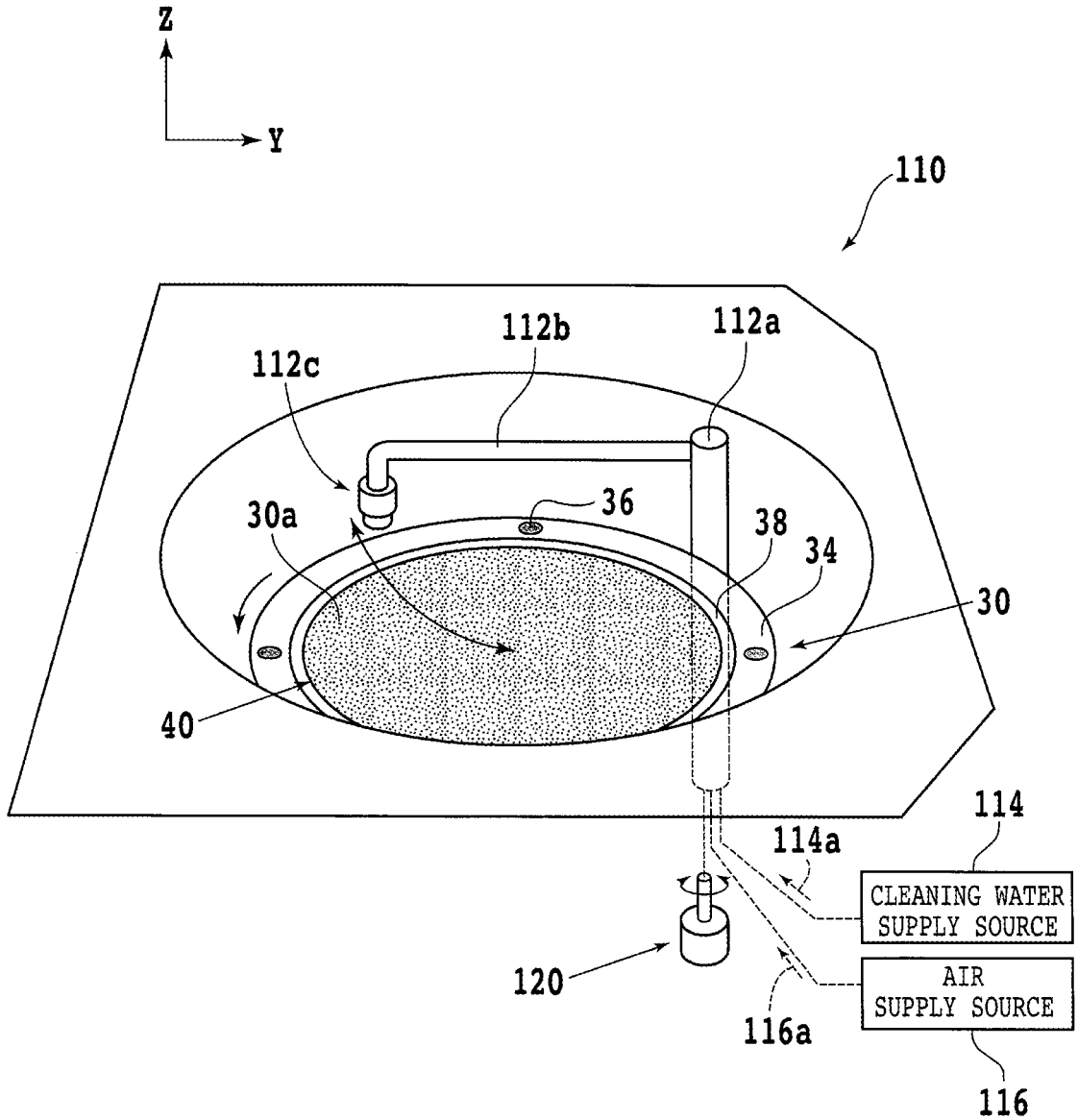
FIG. 8 is an enlarged view of a cleaning unit.

The oscillating mechanism 120 oscillates the nozzle 112*c* at a cleaning position 120A located on an arcuate path (predetermined range) from the center to the peripheral portion 34 of the holding surface 30*a*, directly above the chuck table 30 (see FIGS. 8 and 9). Thus, when the workpiece 11 and the annular frame 15 are to be cleaned, the oscillating mechanism 120 disposes the nozzle 112*c* at the cleaning position 120A. Further, when cleaning is not conducted, the oscillating mechanism 120 moves the nozzle 112*c* to a retracted position 120B located on the upper side and on the more outer side than the peripheral portion 34 of the chuck table 30 (see FIG. 9).

After the conveying-in step S10 to the grinding step S30, a cleaning step S40 is carried out. In the cleaning step S40, a plurality of workpieces 11 are held under suction by the holding surface 30*a* through the protective tape 13, and the one surface 15*a* side of the annular frame 15 is attraction-held by a plurality of permanent magnets 36. Thereafter, the chuck table 30 is rotated, and, while the nozzle 112*c* is oscillated along the abovementioned arcuate path, the binary fluid 118 is jetted downward. As a result, the back surface 11*b* of each workpiece 11 and the other surface 15*c* of the annular frame 15, which are respectively exposed on the upper side, are cleaned.

In the cleaning step S40, the other surface 15*c* of the annular frame 15 is rotated in the X-Y plane, and the nozzle 112*c* is also oscillated along the X-Y plane on which the other surface 15*c* is located. FIG. 9 is a diagram depicting the manner of cleaning the workpieces 11 and the annular frame 15. Note that, though the cleaning power becomes low as compared to that of the binary fluid 118, the air supply source 116 may be stopped and only the cleaning water 114*a* may be jetted from the nozzle 112*c*, or the cleaning water supply source 114 may be stopped and only the air 116*a* may be jetted from the nozzle 112*c*. Besides, two or more of the binary fluid 118, the cleaning water 114*a*, and the air 116*a* may be combined, as required.

The frame unit 17 that has undergone the cleaning step S40 is conveyed by the conveying robot 100 from the cleaning unit 110 into a cassette 98*b* placed on the cassette mount base 96*b*. Also in the second embodiment, the other surface 15*c* of the annular frame 15 can automatically be cleaned by the nozzle (second cleaning member) 112*c*. Thus, a step of manually removing the grinding swarf deposited on the annular frame 15 can be omitted.

Other than the above, the structures, methods, and the like according to the above embodiments can be modified, as required, in carrying out the present invention insofar as the modifications do not depart from the scope of the object of the present invention. For example, also in the second embodiment, electromagnets and electrostatic chucks can be used in place of the permanent magnets. In addition, the workpiece 11 is not limited to a small-type sapphire substrate or SiC substrate of 2 to 4 inches in size. One frame unit 17 may have only one workpiece 11 of 8 to 12 inches in size.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding apparatus comprising:

a chuck table upon which is seated a workpiece, wherein the chuck table holds the workpiece under suction through a protective tape, where the protective tape is attached to one surface of an annular frame so as to cover an opening of the annular frame and the workpiece is attached to the protective tape on an inner side with respect to an inner circumferential edge of the opening of the annular frame, wherein an inner diameter of the annular frame is larger than, and separated from, an outer diameter of the workpiece;

a grinding unit that has a grindstone for grinding the workpiece held by the chuck table; and a frame cleaning unit that cleans a second surface of the annular frame located on a side opposite to the one surface of the annular frame obtained after grinding of the workpiece, wherein the frame cleaning unit has a first cleaning member configured and arranged for making contact with the second surface of the annular frame and having flexibility, and wherein the first cleaning member and the annular frame with the one surface side held by the chuck table are configured and arranged to be relatively moved with respect to each other, such that the second surface of the annular frame is cleaned by the frame cleaning unit, wherein the frame cleaning unit is spaced from a grinding region of the chuck table where grinding of the workpiece is conducted, and the frame cleaning unit is provided adjacent to a conveying-in/conveying-out region where conveying-in and conveying-out of the workpiece relative to the chuck table are performed, and wherein the first cleaning member comprises a plurality of sponge bodies that are spaced from each other and are disposed on a surface of an annular base section that has an inside diameter corresponding to a diameter of the inner circumferential edge of the opening of the annular frame.

2. The grinding apparatus according to claim 1, wherein the frame cleaning unit further includes a driving mechanism that moves the first cleaning member, between a cleaning position located directly above the chuck table and a retracted position located on an outer side than a peripheral part of the chuck table.

3. The grinding apparatus according to claim 1, wherein the workpiece comprises a plurality of wafers that are spaced from each other and from the inner diameter of the annular frame, and wherein the plurality of wafers are all disposed on the protective tape.

4. The grinding apparatus according to claim 1, wherein:

the chuck table includes a holding surface configured and arranged for holding the workpiece thereon through the protective tape;

the holding surface of the chuck table extends in an XY plane; and the first cleaning member is attached to one end of an aim, and the arm is configured and arranged to move between a cleaning position in which the arm is parallel to the XY plane and a retracted position in which the arm extends in a Z-axis direction such that the arm is perpendicular to the XY plane.

5. The grinding apparatus according to claim 1, wherein:

the chuck table includes a holding surface configured and arranged for holding the workpiece thereon through the protective tape;

the holding surface of the chuck table extends in an XY plane; and the first cleaning member is attached to one end of a piston rod of an air cylinder that includes a cylinder tube, and wherein the piston rod is configured and arranged to advance and retract within the cylinder tube.

6. The grinding apparatus according to claim 5, wherein the piston rod extends in a direction parallel to the XY plane.

7. The grinding apparatus according to claim 5, wherein the air cylinder is configured and arranged to move the first cleaning member between a cleaning position in which the first cleaning member is in contact with the annular frame and a retracted position in which the first cleaning member is out of contact with the annular frame.

8. A grinding apparatus comprising:

a chuck table upon which is seated a workpiece, wherein the chuck table holds the workpiece under suction through a protective tape, where the protective tape is attached to one surface of an annular frame so as to cover an opening of the annular frame and the workpiece is attached to the protective tape on an inner side with respect to an inner circumferential edge of the opening of the annular frame, wherein an inner diameter of the annular frame is larger than, and separated from, an outer diameter of the workpiece;

a grinding unit that has a grindstone for grinding the workpiece held by the chuck table; and a frame cleaning unit that cleans a second surface of the annular frame located on a side opposite to the one surface of the annular frame obtained after grinding of the workpiece, wherein the frame cleaning unit has a first cleaning member configured and arranged for making contact with the second surface of the annular frame and having flexibility, and wherein the first cleaning member and the annular frame with the one surface side held by the chuck table are configured and arranged to be relatively moved with respect to each other, such that the second surface of the annular frame is cleaned by the frame cleaning unit, wherein the frame cleaning unit is spaced from a grinding region of the chuck table where grinding of the workpiece is conducted, and the frame cleaning unit is provided adjacent to a conveying-in/conveying-out region where conveying-in and conveying-out of the workpiece relative to the chuck table are performed, and wherein the first cleaning member comprises one annular sponge body having an inside diameter corresponding to a diameter of the inner circumferential edge of the opening of the annular frame.

9. The grinding apparatus according to claim 8, wherein the frame cleaning unit further includes a driving mechanism that moves the first cleaning member, between a cleaning position located directly above the chuck table and a retracted position located on an outer side than a peripheral part of the chuck table.

10. The grinding apparatus according to claim 8, wherein the workpiece comprises a plurality of wafers that are spaced from each other and from the inner diameter of the annular frame, and wherein the plurality of wafers are all disposed on the protective tape.

11. The grinding apparatus according to claim 8, wherein:

the chuck table includes a holding surface configured and arranged for holding the workpiece thereon through the protective tape;

the holding surface of the chuck table extends in an XY plane; and the first cleaning member is attached to one end of an aim, and the arm is configured and arranged to move between a cleaning position in which the arm is parallel to the XY plane and a retracted position in which the arm extends in a Z-axis direction such that the arm is perpendicular to the XY plane.

12. The grinding apparatus according to claim 8, wherein:

the chuck table includes a holding surface configured and arranged for holding the workpiece thereon through the protective tape;

the holding surface of the chuck table extends in an XY plane; and the first cleaning member is attached to one end of a piston rod of an air cylinder that includes a cylinder tube, and wherein the piston rod is configured and arranged to advance and retract within the cylinder tube.

13. The grinding apparatus according to claim 12, wherein the piston rod extends in a direction parallel to the XY plane.

14. The grinding apparatus according to claim 12, wherein the air cylinder is configured and arranged to move the first cleaning member between a cleaning position in which the first cleaning member is in contact with the annular frame and a retracted position in which the first cleaning member is out of contact with the annular frame.

* * * * *